United States Patent [19]

Masuda et al.

[11] 4,003,749

[45] Jan. 18, 1977

[54] HEAT-DEVELOPABLE LIGHT-SENSITIVE MATERIALS USING THE REACTION PRODUCT OF A ORGANIC SILVER SALT AN A N-HALO-OXAZOLIDINONE

[75] Inventors: Takao Masuda; Nobuyoshi Sekikawa, both of Asaka, Japan

[73] Assignee: Fuji Photo Film Co., Ltd., Minami-ashigara, Japan

[22] Filed: July 15, 1975

[21] Appl. No.: 596,130

[30] Foreign Application Priority Data

July 15, 1974 Japan ..... 49-81353

[52] U.S. Cl. ..... 96/114.1; 96/109

[51] Int. Cl.[2] ..... G03C 1/02; G03C 1/34

[58] Field of Search ..... 96/114.1, 109

[56] References Cited

UNITED STATES PATENTS 3,615,549 10/1971 Ohyama et al. ..... 96/109

*Primary Examiner*—David Klein
*Assistant Examiner*—Louis Falasco
*Attorney, Agent, or Firm*—Sughrue, Rothwell, Mion, Zinn & Macpeak

[57] ABSTRACT

A heat-developable light-sensitive material comprising a support having therein or in one or more layers thereon an organic silver (b) a light-sensitive silver halide, and (c) a reducing agent, with the light-sensitive silver halide comprising the reaction product of a part of the organic silver salt and an N-halo compound represented by the following formula (I):

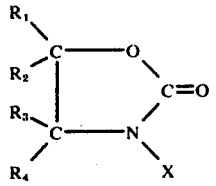

(I)

wherein $R_1$, $R_2$, $R_3$ and $R_4$ each is a hydrogen atom; an alkyl group having 1 to 22 carbon atoms; a haloalkyl group having 1 to 22 carbon atoms; an amino group; a hydroxyalkyl group having 1 to 22 carbon atoms; an allyl group; a naphthyl group; a benzyl group; a

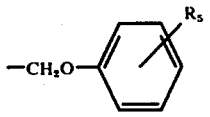

group in which $R_5$ is a hydrogen atom, a halogen atom, an alkyl group, an alkylthio group, an amino group or an alkylamino group; a benzyloxy group; an aryl group; a haloaryl group; an alkylaryl group; and alkoxyaryl group; an $—OR_6$ group in which $R_6$ is a hydrogen atom, an alkyl group, an allyl group, an aryl group or an alkoxyaryl group; a

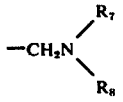

group in which $R_7$ and $R_8$ each is a hydrogen atom, an alkyl group, an aryl group or an allyl group; a cyclohexyl group; a $—CH_2OR_9$ group in which $R_9$ is a naphthyl group; or a $—CH_2R_{10}$ in which $R_{10}$ is a morpholino group, a piperadino group or an alkylthio group; and X is a chlorine atom or a bromine atom.

7 Claims, No Drawings

HEAT-DEVELOPABLE LIGHT-SENSITIVE MATERIALS USING THE REACTION PRODUCT OF A ORGANIC SILVER SALT AN A N-HALO-OXAZOLIDINONE

BACKGROUND OF THE INVENTION

1. Field of the Invention

The present invention relates to a heat-developable light-sensitive material, and more particularly relates to a heat-developable light-sensitive material containing an improved light-sensitive silver halide catalyst and having an improved image stability to light after heat development with less heat fog.

2. Description of the Prior Art

Since photographic processes employing silver halide provide better photographic properties such as sensitivity or gradation than those in electrophotographic processes and diazo photographic processes, they have been widely employed. However, in these processes, the light-sensitive silver halide has to be developed with a developing solution after imagewise exposure, followed by liquid processings, e.g., stopping fixing, washing or stabilizing, in order to protect the formed image from changing in color or fading under normal room illumination, or to protect the background (white portions) non-image areas from being blackened under normal room illumination. There are many problems with liquid processings, in that much time and labor are necessary for the processings, that the handling of the chemicals is dangerous to humans, that the processing rooms and the workers, bodies and clothes are stained, and that pollution problems occur when the waste processing solutions are disposed of. Therefore, a high speed photographic light-sensitive material employing a silver halide has been desired which can be processed by dry treatment and in which stable images and a stable background which is hardly changed in color under normal room illumination, can be obtained.

Various attempts to achieve such have been conducted. For example, German Patents Nos. 1,123,203 and 1,174,157 disclose that heat development of a silver halide emulsion is possible by adding a 3-pyrazolidone type developing agent, and German Patent No. 1,175,075 discloses that heat development can be promoted in the presence of a substance capable of generating water under heating in the above case. Further, German Patent 1,003,578 discloses that a fixing agent for silver halide can be used together with a silver halide. However, it has been impossible with these techniques for the silver halide remaining after the dry processing of the light-sensitive materials to be completely stabilized to light. That is, there is no disclosure in the above three German Patents of fixing the developed photographic materials using a dry processing, and it would be predicted in German Patent No. 1,003,578 that an undesired reaction between the developing agent and the fixing agent would occur on storage of the light-sensitive material. Therefore, it is difficult to practically carry out the process as disclosed in German Patent No. 1,003,578. Such has been confirmed experimentally.

Heat-developable light-sensitive materials which have been thus far used as light-sensitive materials for forming photographic images using a dry processing systems are heat-developable light-sensitive materials utilizing a composition containing a silver salt of an organic acid, a small amount of a light-sensitive silver halide and a reducing agent as essential components. In such a light-sensitive system, the silver halide remaining in the light-sensitive material undergoes a change in color due to light after development and is not stabilized to light, but substantially the same results as in stabilization can be obtained. That is, in the system, since a small amount of silver halide is used and a large amount of an organic silver salt which is hardly blackened by light and is white or a light color are used, even if the color of the silver halide is changed by light, the white or lightly colored background can be maintained and the color change of silver halide is not perceived by the human eye. The light-sensitive material is stable at normal temperature, and when it is heated, after imagewise exposure, to a temperature of 80° C or higher, preferably 100° C or higher, the oxidation-reduction reaction of the organic silver salt oxidizing agent and the reducing agent occurs due to the catalytic action of silver halide located near these materials to form silver, whereby the exposed portions of the light-sensitive layer are promptly blackened to form a contrast between the exposed portions and the unexposed portions (background).

The present invention relates to an improvement in the above-described heat developable light-sensitive material, and particularly, relates to a method for forming a light-sensitive silver halide which is included in the heat developable light-sensitive layer. As the methods of forming such the light-sensitive silver halide, a method for forming a light-sensitive silver halide by the reaction of an N-halo compound with an organic silver salt is known. The present invention relates to an improvement in this latter technique, in which a particular N-halo compound is employed as the N-halo compound, whereby heat fog can be reduced and the light-stability of light-sensitive materials after development can be improved.

SUMMARY OF THE INVENTION

Therefore, an object of the invention is to provide a heat developable light-sensitive material containing an improved light-sensitive silver halide catalyst.

Another object of the invention is to provide a heat developable light-sensitive material having less fog.

A further object of the invention is to provide a heat developable light-sensitive material having good light-stability after development.

These and other objects of the invention will be apparent from the following description of the invention.

The above objects of the invention are attained by a heat developable light-sensitive material comprising a support having therein or in one or more layers thereon (a) an organic silver salt, (b) a light-sensitive silver halide and (c) a reducing agent, with the light-sensitive silver halide being obtained by reaction of a part of the organic silver salt (a) and an N-halo compound represented by the following formula(I):

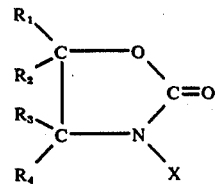

(I)

wherein $R_1$, $R_2$, $R_3$ and $R_4$ each is a hydrogen atom; an alkyl group having 1 to 22 carbon atoms (e.g., methyl, ethyl, isopropyl, propyl, n-butyl, isobutyl, t-butyl, isoamyl, octyl, decyl, dodecyl, tetradecyl, hexadecyl, etc., groups); a haloalkyl group having 1 to 22 carbon atoms (e.g., trichloromethyl, chloromethyl, 2-chloroethyl, 4-chlorobutyl, etc., groups); an amino group (e.g., amino, dimethylamino, diethylamino, di(chloroethyl-)amino, etc., groups); a hydroxyalkyl group having 1 to 22 carbon atoms (e.g., hydroxymethyl, hydroxyethyl, 3-hydroxypropyl, 4-hydroxybutyl, etc., groups); an allyl group; a naphthyl group; a benzyl group; a

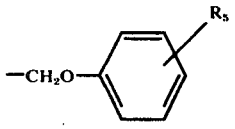

group in which $R_5$ is a hydrogen atom, a halogen atom (e.g., fluorine, chlorine, bromine, etc., atoms), an alkyl group (e.g., having 1 to 4 carbon atoms such as methyl, ethyl, propyl, isopropyl, n-butyl, t-butyl, isobutyl, etc., groups), an alkylthio group (e.g., methylthio, ethylthio, butylthio, dodecylthio, etc., groups), an amino group or an alkyl-substituted amino group (e.g., dimethylamino, diethylamino, di-n-butylamino, di-t-butylamino, etc., groups); a benzyloxy group; an aryl group (e.g., phenyl, $\alpha$-naphthyl, $\beta$-naphthyl, etc., groups); a haloaryl group (e.g., monohalophenyl groups in which the halogen atom is a fluorine, chlorine or iodine atom); an alkylaryl group (e.g., a monoalkylaryl group in which the alkyl moiety contains 1 to 4 carbon atoms such as methyl, ethyl, propyl, iso-propyl, n-butyl, iso-butyl, t-butyl, etc., moieties); an alkoxyaryl group (e.g., a monoalkoxyaryl group in which the alkoxy moiety contains 1 to 4 carbon atoms such as methoxy, ethoxy, propoxy, iso-propoxy, n-butoxy, iso-butoxy, t-butoxy, etc., moieties); an $-OR_6$ group in which $R_6$ is a hydrogen atom, an alkyl group (e.g., methyl, ethyl, n-propyl, iso-propyl, n-butyl, t-butyl, etc., groups), an aryl group (e.g., a phenyl, etc., group), an allyl group or an alkoxyaryl group (e.g., a monoalkoxyaryl group in which the alkoxy moiety contains 1 to 4 carbon atoms such as methoxy, ethoxy, propoxy, iso-propoxy, n-butoxy, iso-butoxy, t-butoxy, etc., moieties); a

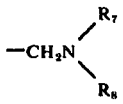

group in which $R_7$ and $R_8$ each is a hydrogen atom, an alkyl group (e.g., methyl, ethyl, n-propyl, iso-propyl, n-butyl, t-butyl, etc., groups), an aryl group (e.g., a phenyl, etc., group) or an allyl group; a cyclohexyl group; a $-CH_2OR_9$ group in which $R_9$ is a naphthyl group; or a $-CH_2R_{10}$ group in which $R_{10}$ is a morpholino group, a piperadino group or an alkylthio group (e.g., methylthio, ethylthio, butylthio, dodecylthio, etc., groups); and X is a chlorine atom or a bromine atom.

DETAILED DESCRIPTION OF THE INVENTION

In spite of any mechanism of the light-sensitive silver halide for attaining the objects of the invention, the following facts were surprising. That is, by using the light-sensitive silver halide of the invention, the heat fog of a heat developable light-sensitive material is reduced and the light-stability of the light-sensitive material after development is increased.

The compounds of the general formula (I) can be easily produced from 2-oxazolidinone, which is well known, by bromination to produce the compounds of the general formula (I), e.g., as disclosed in Kenichi Morita, Bull. Chem. Soc. Japan, 31 347–351 (1958).

It is most important in the invention that the N-haloozazolidinone represented by the above formula (I) is employed to form the light-sensitive silver halide by the reaction with an organic silver salt (a).

Typical examples of the N-haloozazolidinone compounds which can be used are shown below.

Compound 1

N-Bromo-oxazolidinone

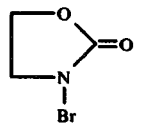

Compound 2

4-Methyl-N-bromo-oxazolidinone

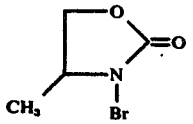

Compound 3

5-Methyl-N-bromo-oxazolidinone

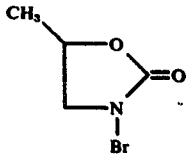

Compound 4

4-Methyl-N-cloro-oxazolidinone

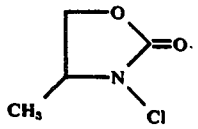

Compound 5

5-Methyl-N-chloro-oxazolidinone

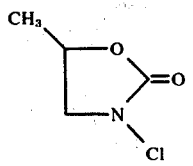

Compound 6

4-Ethyl-N-chloro-oxazolidinone

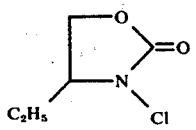

Compound 7

N-Chloro-oxazolidinone

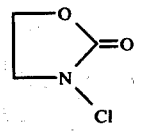

Compound 8

4-Ethyl-N-bromo-oxazolidinone

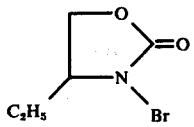

In the following examples, X is Br or Cl.

Compound 9

4-Amino-N-halo-oxazolidinone

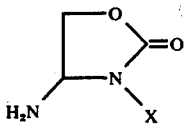

Compound 10

4-Benzyl-4-methyl-N-halo-oxazolidinone

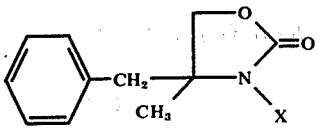

Compound 11

4-Benzyloxy-N-halo-oxazolidinone

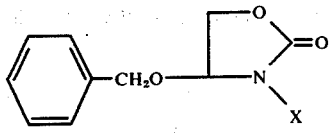

Compound 12

4,4-bis(2-Hydroxyethyl)-N-halo-oxazolidinone

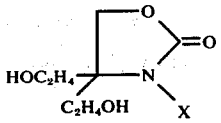

Compound 13

5-[(p-Bromophenoxy)methyl]-N-halo-oxazolidinone

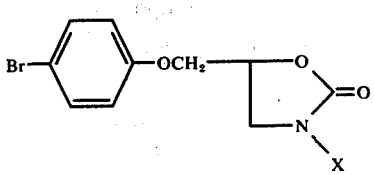

Compound 14

4-t-Butyl-5,5-dimethyl-N-halo-oxazolidinone

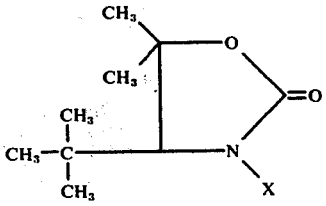

Compound 15

5-t-Butyl-4-phenyl-N-halo oxazolidinone

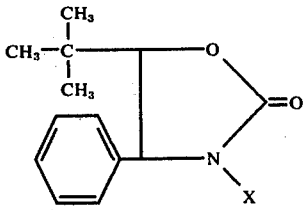

Compound 16

5-[(p-Chlorophenoxy)methyl]-N-halo-oxazolidinone

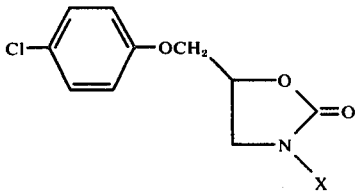

Compound 17

5-Cyclohexyl-4-ethyl-N-halo-oxazolidinone

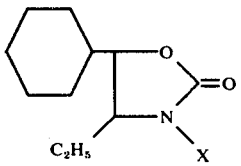

Compound 18

4-Decyl-N-halo-oxazolidinone

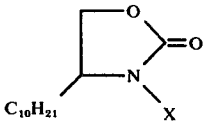

Compound 19

5-[(Dimethylamino)methyl]-N-halo-oxazolidinone

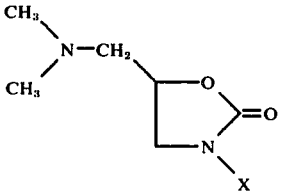

Compound 20

4,4-Dimethyl-N-halo-oxazolidinone

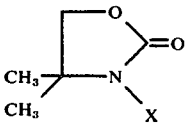

Compound 21

4,5-Dimethyl-N-halo-oxazolidinone

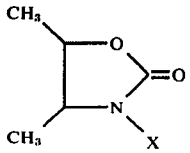

Compound 22

5,5-Dimethyl-N-halo-oxazolidinone

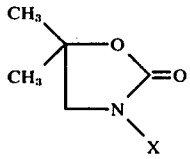

Compound 23

5,5-Dimethyl-4-phenyl-N-halo-oxazolidinone

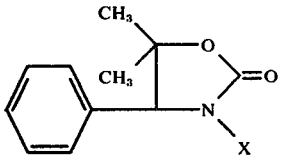

Compound 24

4,5-Dioctyl-N-halo-oxazolidinone

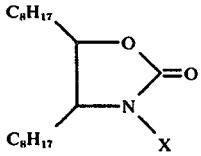

Compound 25

4-[(Dimethylamino)methyl]-5-methyl-N-halo-oxazolidinone

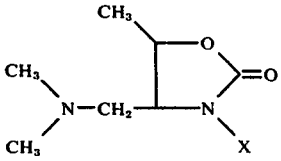

Compound 26

4-Dodecyl-N-halo-oxazolidinone

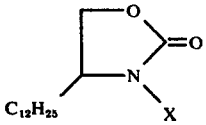

Compound 27

5-Dodecyl-N-halo-oxazolidinone

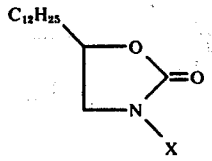

Compound 28

4-Ethoxy-N-halo-oxazolidinone

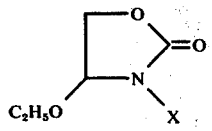

Compound 29

4-Ethyl-4-methyl-N-halo-oxazolidinone

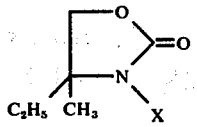

Compound 30

4-Hexadecyl-N-halo-oxazolidinone

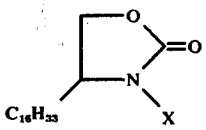

Compound 31

4-Hydroxy-5,5-dimethyl-4-phenyl-N-halo-oxazolidinone

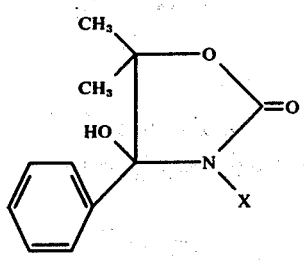

Compound 32

5-(Hydroxymethyl)-N-halo-oxazolidinone

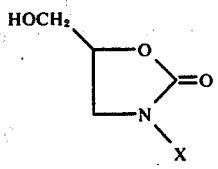

Compound 33

4-(Hydroxymethyl)-4-methyl-N-halo-oxazolidinone

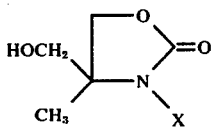

Compound 34

4-Hydroxy-4,5,5-trimethyl-N-halo-oxazolidinone

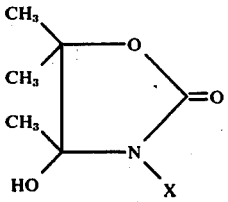

Compound 35

4-Isobutyl-N-halo-oxazolidinone

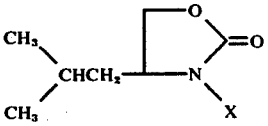

Compound 36

4-Isopropyl-N-halo-oxazolidinone

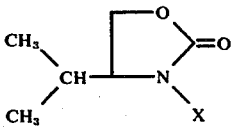

Compound 37

5-Isopropyl-4-phenyl-N-halo-oxazolidinone

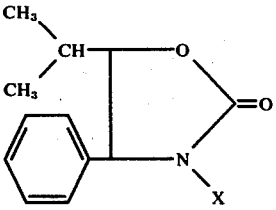

Compound 38

4-Methoxy-N-halo-oxazolidinone

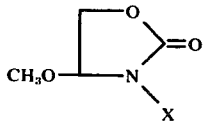

Compound 39

5-[(o-Methoxyphenoxy)methyl]-N-halo-oxazolidinone

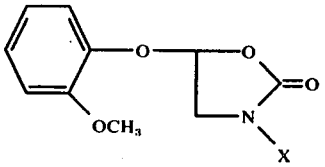

Compound 40

4-Methyl-5-(1-naphthyl)-N-halo-oxazolidinone

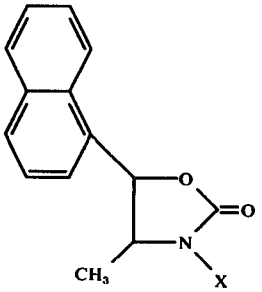

Compound 41

4-Methyl-5-phenyl-N-halo-oxazolidinone

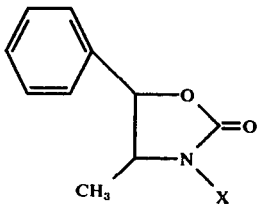

Compound 42

5- [p-(Methylthio)phenoxy]methyl -N-halo-oxazolidinone

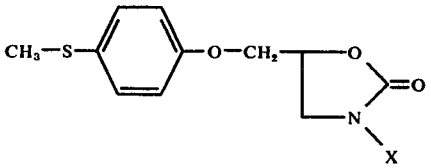

Compound 43

5-(Morpholinomethyl)-N-halo-oxazolidinone

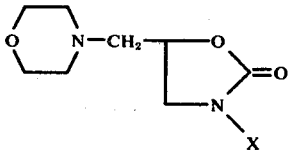

Compound 44

5-(1-Naphthyl)-N-halo-oxazolidinone

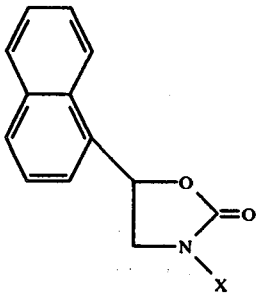

Compound 45

5-[(1-Naphthyloxy)methyl]-N-halo-oxazolidinone

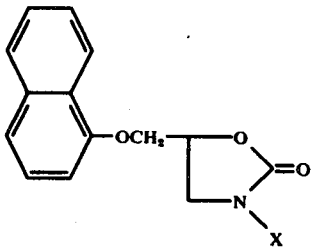

Compound 46

5-Octyl-N-halo-oxazolidinone

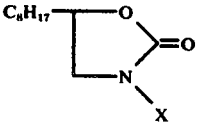

Compound 47

4-Phenyl-N-halo-oxazolidinone

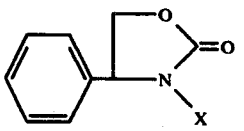

Compound 48

5-(Piperidinomethyl)-N-halo-oxazolidinone

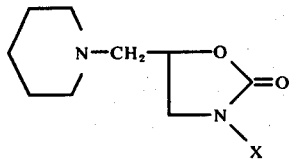

Compound 49

4-Tetradecyl-N-halo-oxazolidinone

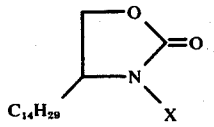

Compound 50

5-(Trichloromethyl)-N-halo-oxazolidinone

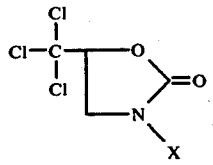

Compound 51

5-(3,4,5-Trimethoxyphenyl)-N-halo-oxazolidinone

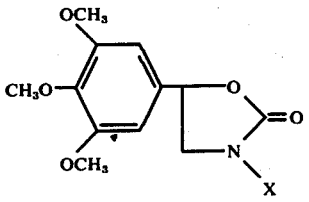

Compound 52

5-[(3,5-Xylyloxy)methyl]-N-halo-oxazolidinone

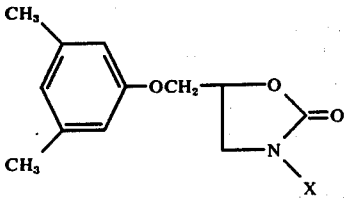

Compound 53

4,5,5-Trimethyl-N-halo-oxazolidinone

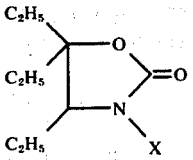

Compound 54

4,5-Diphenyl-N-halo-oxazolidinone

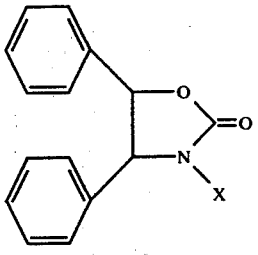

Compound 55

4-(3-Hydroxypropyl)-5-methyl-N-halo-oxazolidinone

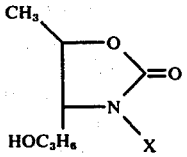

Compound 56

4-Methyl-4-phenyl-N-halo-oxazolidinone

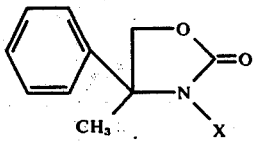

Compound 57

5-Methyl-4-phenyl-N-halo-oxazolidinone

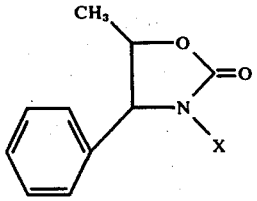

The organic silver salts employed as component (a) in the invention are colorless, white or slightly colored silver salts which are comparatively stable to light and which react with the reducing agents to form silver images when heated to a temperature of about 80° C or higher, preferably 100° C or higher, in the presence of an exposed silver halide. Examples of organic silver salts include silver salts of organic compounds containing an imino group, a mercapto group, a thione group or a carboxyl group. Typical examples of these organic silver salts include:

1. Silver salts of organic compounds containing an imino group:

Silver benzotriazole, silver nitrobenzotriazole, silver alkyl-substituted benzotriazoles (e.g., silver methylbenzotriazole), silver halogen-substituted benzotriazoles (e.g., silver bromobenzotriazole or silver chlorobenzotriazole), silver carboimide-substituted benzotriazoles (e.g.,

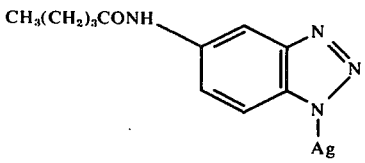

or

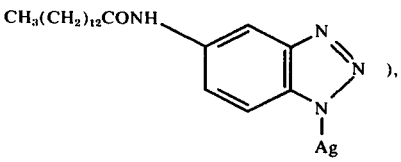

silver benzoimidazole, silver substituted-benzimidazoles (e.g., silver 5-chlorobenzimidazole or silver 5-nitrobenzimidazole), silver carbazole, silver saccharin, silver phthalazinone, silver substituted-phthalazinone, silver salts of phthalimides, silver pyrrolidone, silver tetrazole and silver imidazole;

2. Silver salts of organic compounds containing a mercapto group or a thione group:

Silver 3-mercapto-4-phenyl-1,2,4-triazole, silver 2-mercaptobenzimidazole, silver 2-mercapto-5-aminothiadiazole, silver 1-phenyl-5-mercaptotetrazole, silver 2-mercaptobenzothiazole, silver salts of the thioglycolic acids as described in Japanese Patent Application (OPI) 28,221/73 (e.g., silver 2-(S-ethylenethioglycolamido)benzthiazole or silver S-alkyl($C_{12}$ – $C_{22}$)thioglycolates), silver salts of dithiocarboxylic acids (e.g., silver dithioacetate), silver thioamide, silver salts of thiopyridines (e.g., silver 5-carbethoxy-1-methyl-2-phenyl-4-thiopyridine), silver dithiohydroxybenzole, silver mercaptotriazine, silver 2-mercaptobenzoxazole and silver mercaptooxadiazole, etc.;

3. Silver salts of organic compounds containing a carboxylic group:

a. Silver salts of aliphatic carboxylic acids:

Silver caprate, silver laurate, silver myristate, silver palmitate, silver stearate, silver behenate, silver maleate, silver fumarate, silver tartarate, silver furoate, silver linolate, silver oleate, silver hydroxystearate, silver adipate, silver sebacate, silver succinate, silver acetate, silver butyrate and silver camphorate;

b. Silver aromatic carboxylates and the others:

Silver benzoate, silver 3,5-dihydroxybenzoate, silver 0-methylbenzoate, silver m-methylbenzoate, silver p-methylbenzoate, silver 2,4-dichlorobenzoate, silver acetamidobenzoate, silver p-phenylbenzoate, silver salts of other substituted benzoic acids, silver gallate, silver tannate, silver phthalate, silver terephthalate, silver salicylate, silver phenylacetate, silver pyromellitate, silver 4′-n-octadecyloxydiphenyl-4-carboxylate, silver thionecarboxylates as disclosed in U.S. Pat. 3,785,830 and silver salts of aliphatic carboxylic acids containing a thioether group as disclosed in U.S. Pat. No. 3,330,663;

4. Other silver salts:

Silver 4-hydroxy-6-methyl-1,3,3a,7-tetraazaindene, silver 5-methyl-7-hydroxy-1,2,3,4,6-pentaazindene, silver tetraazindene as disclosed in British Patent 1,230,642, silver S-2-aminophenylthiosulfate as disclosed in U.S. Pat. No. 3,549,379, metal-containing aminoalcohols as disclosed in Japanese Patent Application (OPI) 6,586/71, and organic acid-metal chelates as disclosed in Belgian Patent 768,411.

An oxidizing agent such as titanium dioxide, zinc oxide or gold carboxylates (e.g., aurous laurate, aurous stearate or aurous behenate) other than silver salts can be employed together with the organic silver salt, if desired.

Various processes are known for preparing such organic silver salts. One of the simplest processes for preparing them is described in U.S. Pat. No. 3,457,075 wherein a solution of an organic silver salt forming agent or a salt thereof in a water-miscible solvent, such as an alcohol or acetone, or water is mixed with an aqueous solution of a water-soluble silver salt such as silver nitrate to prepare an organic silver salt.

Further, it is possible to use the process described in U.S. Pat. No. 3,839,049 wherein a colloidal dispersion of an ammonium salt or an alkali metal salt of an organic silver salt forming agent is mixed with an aqueous solution of a water-soluble silver salt such as silver nitrate. In a similar process, it is possible to use an aqueous solution of a silver complex salt such as a silver amine complex salt or a solution of such a salt in a water-miscible solvent instead of the aqueous solution of the water-soluble silver salt such as silver nitrate.

Another process for preparing organic silver salts is the process described in U.S. Pat. No. 3,458,544. Namely, in this process, organic carboxylic acid silver salts are prepared by mixing a water difficultly-miscible solution (oily solution) such as a benzene solution of an organic carboxylic acid with an aqueous solution of a silver complex salt. Preferably the water is added to the oily solution to form an emulsion prior to mixing with the aqueous solution of the silver complex salt. This process can be also applied to the preparation of other organic silver salts.

A similar process has been described in Canadian Patent 847,351 wherein the resulting organic silver salts are more stable to heat and light. In this process, a silver salt solution without using an alkali such as an aqueous solution containing only silver nitrate is used instead of the silver complex salt.

Further, a process for preparing organic silver salts is described in West German Patent Application (OLS) 2,402,906. This process is preferred because heat-developable light-sensitive materials containing the resulting organic silver salt do not form as much heat-fog (undesirable fog generated on the unexposed area when the light-sensitive material is heated). Namely, this process comprises mixing an emulsion composed of an aqueous solution of a salt (for example, an alkali metal salt such as sodium salt, potassium salt or lithium salt or an ammonium salt, etc.) of a water-soluble organic silver salt forming agent and an oil (for example, benzene, toluene, cyclohexane, pentane, hexane, carboxylic acid esters such as an acetate, phosphoric acid esters, and oils such as castor oil, etc.) with a solution of, and preferably an aqueous solution of, a silver salt which is more water-soluble than the organic silver salt (such as silver nitrate) or a silver complex salt to prepare the organic silver salt. In another embodiment of this process, it is possible to prepare the organic silver salt by mixing an aqueous alkali solution (for example, an aqueous solution of sodium hydroxide) with an oil-soluble solution of an organic silver salt forming agent (for example, a toluene solution of the organic silver salt forming agent) and mixing the resulting emulsion with a solution, and preferably an aqueous solution, of a soluble silver salt such as silver nitrate or a silver complex salt such as a silver ammine complex salt.

The oils which can be used for the above-described oily solution include the following compounds:

1. Phosphoric acid esters:
For example, tricresyl phosphate, tributyl phosphate, and monooctyl dibutyl phosphate, etc.

2. Phthalic acid esters:
For example, diethyl phthalate, dibutyl phthalate, dimethyl phthalate, dioctyl phthalate and dimethoxyethyl phthalate, etc.;

3. Carboxylic acid esters:
For example, acetates such as amyl acetate, isopropyl acetate, isoamyl acetate, ethyl acetate, 2-ethylbutyl acetate, butyl acetate and propyl acetate, etc.; sebacates such as dioctyl sebacate, dibutyl sebacate, and diethyl sebacate, etc.; succinates such as diethyl succinate; formates such as ethyl formate, propyl formate, butyl formate and amyl formate, etc.; tartarates such as diethyl tartarate; valerates such as ethyl valerate; butyrates such as methyl butyrate, ethyl butyrate, butyl butyrate and isoamyl butyrate; and adipic acid esters, etc.;

4. Oils such as castor oil, cotton seed oil, linseed oil and tsubaki oil, etc.;

5. Aromatic hydrocarbons such as benzene, toluene and xylene, etc.;

6. Aliphatic hydrocarbons such as pentane, hexane and heptane, etc.; and

7. Cyclic hydrocarbons such as cyclohexane.

Examples of silver complex salts include silver ammine complex salt, silver methylamine complex salt and silver ethylamine complex salt, and preferably alkali-soluble complex salts having a dissociation constant higher than the organic silver salts are suitably used.

Examples of solvents for the silver salts such as silver nitrate include not only water but also polar solvents such as dimethyl sulfoxide, dimethylformamide and acetonitrile, etc.

Further, ultrasonic waves can be employed during the preparation of the organic silver salts as described in West German Patent application (OLS) 2,401,159. Particularly, emulsification can be easily carried out by applying ultrasonic waves when it is desired to emulsify water and oils. Further, it is possible to use surface active agents for the purpose of controlling the particle size of the organic silver salts during the preparation thereof.

The organic silver salts can also be prepared in the presence of polymers. A specific process has been described in U.S. Pat. NO. 3,700,458, which comprises mixing a non-aqueous solution of an organic carboxylic acid with a non-aqueous solution of a heavy metal salt of trifluoroacetate or tetrafluoroborate in the presence of a polymer to produce a heavy metal salt of the organic carboxylic acid such as a silver salt thereof. A process which comprises reacting a colloid dispersion of an organic silver salt forming agent with an aqueous solution of silver nitrate has been described in U.S. Pat. No. 3,839,049. Furthermore, a process for producing an emulsion using similar non-aqueous solutions has been described in U.S. Pat. No. 3,748,143. In addition, it is possible, as described in Japanese Patent Application (OPI) 13,224/1974, West German Patent Application (OLS) 2,322,096, to change the particle form, the particle size and photographic properties such as light stability or sensitivity of the organic silver salts due to the presence of a metal salt or a metal complex such as a mercury or lead compound during the preparation of the organic silver salts.

It has been also confirmed that cobalt, manganese, nickel, iron, rhodium, iridium, platinum, gold, cadmium, zinc, lithium, copper, thallium, tin, bismuth, antimony, chromium, ruthenium, palladium and osmium in addition to the mercury and lead described above are effective as the metal. In order to use these metal containing compounds, a mixture or dispersion of a solution of a silver salt forming organic compound and a metal containing compound can be mixed with an aqueous solution of a soluble silver salt such as silver nitrate or an aqueous solution of a silver complex salt such as a silver ammine complex salt. Further, a solution or dispersion of the metal containing compound can be mixed with an aqueous solution of the silver salt or a silver complex salt and a solution or dispersion of the silver salt forming organic compound. Furthermore, a method comprising mixing a solution or dispersion of the silver salt forming organic compound with a solution or dispersion of a mixture of the silver salt or silver complex salt and the metal containing compound is also preferred. A preferred amount of the metal containing compound ranges from about $10^{-6}$ to $10^{-1}$ mols per mol of the organic silver salt and from about $10^{-5}$ to $10^{-2}$ mols per mol of the silver halide.

The particle size of thus-resulting organic silver salts is about 0.01 micron to about 10 microns as the longer diameter and preferably about 0.1 micron to about 5 microns.

Examples of light-sensitive silver halides which can be employed as component (b) in the invention include silver chloride, silver bromide, silver iodide, silver chlorobromoiodide, silver chlorobromide, silver chloroiodide, silver iodobromide and a mixture thereof. The light-sensitive silver halide can be coarse particles or fine particles, but preferably are fine particles. A preferred particle size of the silver halide is about 0.001 to 1 micron, more preferably about 0.01 to 0.5 micron, in the longer diameter.

The silver halide used in the invention can be chemically sensitized with a chemical sensitizer such as sulfur, selenium, tellurium, gold, platinum, palladium, a stannous halide, etc., e.g., as disclosed in U.S. Pat. Nos. 1,623,499, 2,399,083 and 3,297,447. The silver halide preferably contains an antifoggant or a stabilizer such as a thiazolium salt, an azaindene, a mercury salt, a urazole, a sulfocatecol, an oxime, a nitron, a nitroindazole, etc., to stabilize the silver halide to fog, e.g., as disclosed in U.S. Pat. Nos. 2,728,663, 2,839,405, 2,566,263, 2,597,915 and British Patent 623,448.

The light-sensitive silver halide employed in the invention can be simultaneously prepared with the preparation of the organic silver salt as disclosed in Japanese Patent Application 65,727/73. That is, the silver halide can be prepared by mixing a silver salt (e.g., silver nitrate or a silver complex salt) solution with a solution or dispersion of an organic silver salt-forming compound or a salt thereof and the N-halo compound of the invention, or by mixing the N-halo compound with a mixture of a solution or dispersion of an organic silver salt-forming compound or a salt thereof and a solution of a silver salt such as silver nitrate or a silver complex salt, whereby silver halide is prepared simultaneously with the organic silver salt. Further, the light-sensitive silver halide employed in the invention can be prepared by a partial conversion of the organic silver salt by subjecting a solution or dispersion of the previously prepared organic silver salt to the N-halo compound of the invention. The thus-prepared silver halide is effectively contacted with the organic silver salt to provide preferred results as disclosed in U.S. Pat. No. 3,457,075.

The N-halo compound of the invention preferably is used individually, but can be used with other light-sensitive silver halide forming components. Examples of other light-sensitive silver halide forming components which can be employed include any compounds capable of forming silver halide with the organic silver salt. Whether the compounds can be employed as a silver halide forming component can be determined by a routine test. For example, after mixing a compound for forming a silver halide with the organic silver salt, and if necessary heating, the X-ray diffraction pattern obtained by an X-ray diffraction method is examined to determine whether diffraction peaks inherent to silver halide are present.

Examples of silver halide forming components include the following compounds.

1. Inorganic halides:

For example, halides represented by the formula $MX'_n$, wherein M represents H, $NH_4$ or a metal atom, X' represents Cl, Br or I, and n is 1 if M represents H or $NH_4$, or n represents the valence of the metal atom if M represents a metal atom. Examples of suitable metal atoms include lithium, sodium, potassium, rubidium, cesium, copper, gold, beryllium, magnesium, calcium, strontium, barium, zinc, cadmium, mercury, aluminum, gallium, indium, thallium, germanium, tin, lead, antimony, bismuth, chromium, molybdenum, tungsten, manganese, rhenium, iron, cobalt, nickel, ruthenium, rhodium, palladium, osmium, iridium and platinum.

2. Halogen containing metal complexes:

For example, $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_3RhCl_6$ and $(NH_4)_3RhBr_6$, etc.

3. Onium halides:

For example, quaternary ammonium halides such as trimethylphenyl ammonium bromide, cetylethyldimethyl ammonium bromide and trimethylbenzyl ammonium bromide, quaternary phosphonium halides such as tetraethyl phosphonium bromide and tertiary sulfonium halides such as trimethyl sulfonium iodide. Further, these onium halides can be used in final coating dispersions for the purpose of decreasing sensitivity or, if desired, decreasing the background density, as described in U.S. Pat. No. 3,679,422.

4. Halogenated hydrocarbons:

For example, iodoform, bromoform, carbon tetrabromide and 2-bromo-2-methylpropane, etc.

5. N-halogen compounds:

For example, compounds represented by the following formulae:

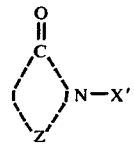

(II)

and

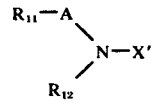

(III)

wherein X' represents Cl, Br or I; Z represents a group of atoms necessary to form a 5- or 6-membered ring, wherein the 5- or 6-membered ring may be condensed with another ring; A represents a carbonyl group or a sulfonyl group; and $R_{11}$ and $R_{12}$ each represents an alkyl group, an aryl group or an alkoxy group. For example, N-bromosuccinimide, N-bromophthalimide, N-bromoacetamide, N-iodosuccinimide and N-bromophthaladinone, etc., are suitable. These compounds have been described in detail in West German Patent Application (OLS) 2,453,131. In addition, N-halo compounds of benzotriazole and substituted benzotriazoles such as the alkyl, nitro, halo, imido or amino substituted benzotriazoles are also effective. Furthermore, N-bromobenzimidazoles are suitable.

6. Other halogen containing compounds:

For example, triphenylmethyl chloride, triphenylmethyl bromide, 2-bromobutyric acid, 2-bromoethanol and dichlorobenzophenone, etc.

In the above-described processes and the process of the present invention, the improvement of photographic properties, such as increase of sensitivity and elimination of heat-fog, etc., can be achieved by ripening by allowing the composition to stand at room temperature (about 20° - 25° C) to a higher temperature (30° C - 80° C) for a suitable time (for example, 20 minutes to 48 hours) after addition of the silver halide forming component.

The amount of the N-halo compound of the formula (I) is about 0.001 to 0.5 mol, preferably about 0.01 to 0.3 mol, per mol of the organic silver salt employed as the component (a). If the amount is more than about 0.5 mol, the color changes which is an undesirable coloration of the background which occurs on allowing the exposed and developed light-sensitive material to stand under normal room illumination. If the amount is less than about 0.001, the sensitivity is reduced.

The reducing agent of component (c) used in the heat developable light-sensitive materials of the present invention can be suitably selected depending upon the organic silver salt with which it is used in combination. Examples of such reducing agents include substituted phenols, substituted phenols, substituted or unsubstituted bisphenols, substituted or unsubstituted mono- or bisnaphthols, di- or polyhydroxybenzenes, di- or polyhydroxynaphthalenes, hydroquinone monoethers, ascorbic acid and derivatives thereof, 3-pyrazolidones, pyrazolin-5-ones, reducing saccharides, aromatic primary amino compounds, reductones, kojic acid, hinokitiol, hydroxylamines, hydroxytetronic acids, hydroxytetronic acid amides, hydroxamic acids, sulfhydrooxamic acids, hydrazides, indan-1,3-diones and p-oxyphenylglycines, etc. Of these reducing agents, reducing agents which are photolytically decomposed are preferred. Photolytically decomposable reducing agents are described in U.S. Pat. No. 3,827,889. Further, it is possible to use the reducing agents together with compounds which accelerate the photolysis, as described in U.S. Patent 3,756,829. Blocked bisphenol type reducing agents are also used as preferred compounds and have been described in, for example, U.S. Pat. No. 3,589,903 and Japanese Patent Applications 81,625/1973 and 22,135/1974. Other examples of the reducing agents which can be used in the present invention are described in U.S. Patents 3,152,904, 3,457,075, 3,531,286, 3,615,533, 3,679,426, 3,672,904, 3,751,252, 3,751,255, 3,782,949, 3,770,448 and 3,773,512, U.S. Patent 3,819,382 and Belgian Patent 786,086.

Examples of suitable reducing agents are as follows:

1. Substituted phenols:

Aminophenols, for example, 2,4-diaminophenol, methylaminophenol, p-aminophenol, o-aminophenol, 2-methoxy-4-aminophenol and 2-β-hydroxyethyl-4-aminophenol, etc.; alkyl-substituted phenols, for example, p-t-butylphenol, p-t-amylphenol, p-cresol, 2,6-di-t-butyl-p-cresol, p-ethylphenol, p-sec-butylphenol, 2,3-dimethylphenol, 3,4-xylenol, 2,4-xylenol, 2,4-di-t-butylphenol, 2,4,5-trimethylphenol, p-nonylphenol and p-octylphenol, etc.; other phenols, for example, p-acetophenol, p-acetoacetyl-4-methylphenol, 1,4-dimethoxyphenol, 2,6-dimethoxyphenol, chlorothymol, 3,5-di-t-butyl-4-hydroxybenzyl-dimethylamine, and sulfonamidophenols, for example, compounds described in U.S. Patent 3,801,321; and novolak resin type reaction products of formaldehyde and phenol derivatives (for example, 4-methoxyphenol, m-cresol, o- or p-butylphenol, 2,6-di-t-butylphenol and mixtures thereof, etc.);

2. Substituted or unsubstituted bisphenols: o-bis-Phenols, for example, 1,1-bis-(2-hydroxy-3,5-dimethylphenyl)-3,5-trimethylhexane, bis-(2-hydroxy-3-t-butyl-5-methyl-phenyl)methane, bis-(2-hydroxy-3,5-di-t-butylphenyl)methane, bis-(2-hydroxy-3-t-butyl-5-ethylphenyl)methane, 2,6-methylene-bis-(2-hydroxy-3-t-butyl-5-methylphenyl)-4-methylphenol, 1,1-bis-(5-chloro-2-hydroxyphenyl)methane, 2,2'-methylene-bis-[4-methyl-6-(1-methylcyclohexyl)phenol], 1,1-bis-(2-hydroxy-3,5-dimethylphenyl)-2-methylpropane, 1,1,5,5-tetrakis-(2-hydroxy-3,5-dimethylphenyl)-2,4-ethylpentane and 3,3',5,5'-tetramethyl-6,6'-dihydroxytriphenylmethane; p-bis-phenols, for example, bisphenol A, 4,4'-methylene-bis-(3-methyl-5-t-butylphenol), 4,4'-methylene-bis-(2,6-di-t-heptylidene)-di-(o-cresol), 4,4'-ethylidene-bis-(2,6-di-tert-butylphenol), 4,4'-(2-butylidene)-di-(2,6-xylenol), 4,4'-(p-methylbenzylidene)-di-(o-cresol), 4,4'-(p-methoxybenzylidene)-bis-(2,6-di-tert-butylphenol), 4,4'-(p-nitrobenzylidene)-di-(2,6-xylenol) and 4,4'-(p-hydroxybenzylidene)-di-(o-cresol); and others, for example, 3,5-di-t-butyl-4-hydroxybenzyldimethylamine, polyphenols such as α,α'-(3,5-di-t-butyl-4-hydroxyphenyl)-dimethylether, 2,4,6-tris-(3,5-di-t-butyl-4-hydroxybenzyl)phenol, N,N'-di-(4-hydroxyphenyl)urea and tetrakis-[methylene-(3,5-di-t-butyl-4-hydroxyhydrocinnamate]methane, diethylstibestrol, hexestrol, bis-(3,5-di-t-butyl-4-hydroxybenzyl)ether and 2,6-bis-(2'-hydroxy-3'-t-butyl-5'-hydroxybenzyl)-4-methylphenol, etc.

3. Substituted or unsubstituted mono- or bis-naphthols and di- or polyhydroxynaphthalenes: bis-β-Naphthols, for example, 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, bis-(2-hydroxy-1naphthyl)methane and 4,4'-dimethoxy-1,1'-dihydroxy-2,2'-binaphthyl; naphthols, for example, α-naphthol, β-naphthol, 1-hydroxy-4-aminonaphthalene, 1,5-dihydroxynaphthalene, 1,3-dihydroxynaphthalene, 1-hydroxy-2-phenyl-4-methoxynaphthalene, 1-hydroxy-2-methyl-4-methoxynaphthalene, 1-hydroxy-4-methoxynaphthalene, 1,4-dihydroxynaphthalene, methylhydroxynaphthalene, sodium 1-amino-2-naphthol-6-sulfonate, 1-naphthylamine-7-sulfonic acid and sulfonamidonaphthols.

4. Di- or polyhyroxybenzenes and hydroxy-monoethers (e.g., as described in, for example, U.S. Pat. No. 3,801,321): Hydroquinone; alkyl substituted hydroquinones, for example, methylhydroquinone, t-butylhydroquinone, 2,5-dimethylhydroquinone, 2,6-dimethylhydroquinone and t-octylhydroquinone, etc.; halogen-substituted hydroquinones, for example, chlorohydroquinone, dichlorohydroquinone and bromohydroquinone, etc.; alkoxy-substituted hydroquinone, for example, methoxyhydroquinone and ethoxyhydroquinone, etc.; other substituted hydroquinones, for example, phenylhydroquinone and hydroquinone monosulfonate, etc.; hydroquinone monoethers, for example, p-methoxyphenol, p-ethoxyphenol, hydroquinone monobenzyl ether, 2-t-butyl-4-methoxyphenol, 2,5-di-t-butyl-4-methoxyphenol, hydroquinone mono-n-propyl ether and hydroquinone mono-n-hexyl ether; and others, for example, catechol, pyrogallol, resorcinol, 1-chloro-2,4-dihydroxybenzene, 3,5-di-t-butyl-2,6-dihydroxybenzoic acid, 2,4-dihydroxybenzoic acid, 2,4-dihydroxyphenyl sulfide, methyl gallate, and propyl gallate, etc.

5. Ascorbic acid and derivatives thereof: *l*-Ascorbic acid; isoascorbic acid; ascorbic acid monoesters, for example, ascorbic acid monolaurate, monomyristate, monopalmitate, monostearate and monobehenate; ascorbic acid diesters, for example, ascorbic acid dilaurate, dimyristate, dipalmitate and distearate; and the compounds described in U.S. Pat. No. 3,337,342.

6. 3-Pyrazolines and pyrazolones:

For example, 1-phenyl-3-pyrazolidone, 4-methyl-4-hydroxymethyl-1-phenyl-3-pyrazolidone, the compounds described in British Patent 930,572, and 1-(2-quinolyl)-3-methyl-5-pyrazolone, etc.

7. Reducing saccharides:

For example, glucose and lactose, etc.

8. Aromatic primary amino compounds:

Examples of typical compounds include inorganic salts of N,N-diethyl-p-phenylenediamine, 2-amino-5-diethylaminotoluene, 2-amino-5-(N-ethyl-N-laurylamino)toluene, 4-[N-ethyl-N-(β-hydroxyethyl-)amino]aniline and 3-methyl-4-amino-N-ethyl-N-(β-hydroxyethyl)aniline, 4-amino-3-methyl-N-ethyl-N-(β-methane-sulfoamidoethyl)aniline sesquisulfate monohydrate as described in U.S. Pat. No. 2,193,015, N-(2-amino-5-diethylaminophenylethyl)-methanesulfoamide sulfate as described in U.S. Pat. No. 2,592,364, N,N-dimethyl-p-phenylenediamine hydrochloride and 3-methyl-4-amino-N-ethyl-N-methoxyethylaniline as described in Japanese Patent Application (OPI) 64,933/1973. These compounds have been described in L.F.A. Mason, Photographic Processing Chemistry, pages 226 – 229, Focal Press, London (1966).

9. Hydroxylamines:
For example, N,N-di-(2-ethoxyethyl)hydroxylamine, etc.

10. Reductones:
Anhydro-dihydroaminohexose reductones as described in, for example, U.S. Pat. No. 3,679,426, and linear aminoreductones as described in Belgian Patent 786,086.

11. Hydroxamic acids:
For example, hydroxamic acids as described in U.S. Pat. Nos. 3,751,252 and 3,751,255.

12. Hydrazides:
For example, hydroxy substituted aliphatic acid aryl hydrazides as described in U.S. Pat. 3,782,949.

13. Other compounds:
For example, pyrazoline-5-ones as described in U.S. Pat. No. 3,770,448, indan-1,3-diones having at least one hydrogen atom at the 2-position thereof as described in U.S. Pat. 3,773,512; amidoximes as described in U.S. Pat. No. 3,794,488, and reducing agents as described in U.S. Pat. No. 3,615,533 and German Patent Application (OLS) No. 3,819,382.

Of these reducing agents, the compounds having an alkyl group (e.g., a methyl group, an ethyl group, a propyl group, an isopropyl group, a butyl group or an amyl group) on at least one position adjacent to the position at which a hydroxyl group is bonded to an aromatic nucleus are preferred because they are stable to light and color change due to exposure to light is small. For example, mono-, bis-, tris or tetrakis phenols having a 2,6-di-tert-butyl-phenol group are preferred examples of reducing agents. Typical examples of these compounds are (i) esters of carboxylic acids derived from phenols having a bulky substituent in at least one ortho-position with monohydric or poly-hydric alcohols or phenols, and (ii) esters of alcohols derived from phenols having a bulky substituent in at least one ortho-position or phenols having a bulky substituent in at least one ortho-position with mono- or polycarboxylic acids. These esters can be represented by the formulae:

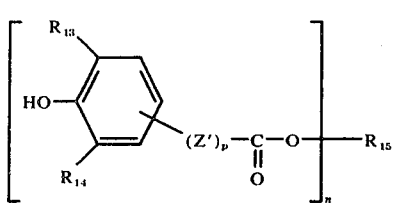

(VI)

wherein Z is a di-valent group containing up to 30 carbon atoms, $R_{13}$ is an alkyl group having 1 to 20 carbon atoms, $P_{14}$ is a hydrogen atom or an alkyl group having 1 to 20 carbon atoms, $R_{15}$ is an alcohol residue, $R_{16}$ is a carboxylic acid residue, n and m each is a positive integer which is equal to number of alcohol and carboxylic acid residues, respectively, esterified, and p is 0 or 1. Specific examples of these compounds includes tetrakis-[methylene-(3,5-di-tert-butyl-4-hydroxyhydrocinnamate)]methane and octadecyl-3-(3',5'-di-tert-butyl-4'-hydroxyphenyl)propionate.

Further, photodecomposable reducing agents such as ascorbic acid and the derivatives thereof, furoin, benzoin, dihydroxyacetone, glyceraldehyde, rhodizonic acid tetrahydroxyquinone, 4-methoxy-1-naphthol, etc., are preferred. They are decomposed by light even if the light-sensitive materials in which they are present are allowed to stand in the light after development, whereby reduction does not proceed and so no color change occurs. Furthermore, direct positive images can be obtained by destroying the reducing agent upon imagewise exposure as disclosed in Japanese Patent Publications 22,185/70 and 41,865/71.

Two or more reducing agents can be used. Examples of the two or more reducinng agents used in combination are disclosed in Japanese Patent Application 27,242/73, U.S. Patents 3,667,958 and 3,751,249. It has also been confirmed that the development can be accelerated by using the reducing agent in combination with a tin compound, an iron compound, a cobalt compound, or a nickel compound.

A suitable reducing agent used is selected based on the combination of the organic silver salt employed as the component (a) with which the reducing agent is used. For example, a strong reducing agent is suitable for a silver salt such as a silver salt of benzotriazole or silver behenate which is comparatively difficult to reduce and a weak reducing agent is suitable for a silver salt such as silver caprate or silver laurate which is comparatively easy to reduce. That is, once the organic silver salt is determined, the reducing agent can be selected depending on the organic silver salt. Suitable reducing agents for silver benzotriazole are 1-phenyl-3-pyrazolidones, ascorbic acid, ascorbic acids monoesters and naphthols such as 4-methoxy-1-naphthols. Suitable reducing agents for silver behenate are o-bisphenols and hydroquinone. Suitable reducing agents for silver caprate and silver laurate are substituted tetrakisphenols, p-bisphenols such as substituted bisphenol A, and p-phenylphenol. The selection of an appropriate reducing agent for the organic silver salt can be facilitated by using two or more reducing agents.

The amount of the reducing agent used in the invention can widely vary depending on the kind of organic silver salt used, the kind of reducing agent used and the other additives present, but the amount of the reducing agent is generally about 0.05 to 5 mols, preferably about 0.1 to 2 mols per mol of the organic silver salt.

In forming a black image of silver using the heat developable light-sensitive material of the present invention, a color toning agent as an additive is preferably incorporated in the material. The color toning agent is used when it is desired to change the formed image into a deep color image and particularly into a black image. The amount of the color toning agent generally ranges from about 0.0001 mol to about 2 mols, and preferably about 0.0005 mol to about 1 mol, per mol of the organic silver salt. Although the color toning agent which is effective depends upon the organic silver salt and the reducing agent used, in general, heterocyclic organic compounds containing at least two hetero atoms wherein at least one nitrogen atom is present in the ring are used as a color toning agent. These compounds are described in, for example, U.S. Patent 3,080,254. Phthalazone (phthalazinone), phthalic acid anhydride, 2-acetylphthalazinone, 2-phthaloylphthalazinone and substituted phthalazinone derivatives as described in West German Patent Application (OLS) 2,449,252 also can be suitably used in the present invention.

Examples of other effective color toning agents include pyrazolin-5-ones, cyclic imides and quinazolinone, as described in U.S. Pat. No. 3,846,136. For example, phthalimide, N-hydroxyphthalimide, N-potassium phthalimide and silver phthalimide are typical. Silver phthalazinone is also effective as a color toning agent. Other effective color toning agents are the mercapto compounds described in U.S. Pat. No. 3,832,186 and West German Patent Application (OLS) 2,321,217. In addition, the oxazinediones as described in West German Patent Application (OLS) 2,422,012, the phthalazine diones described in West German Patent Application (OLS) 2,449,252, the uracils described in Japanese Patent Application 18,378/1974, the N-hydroxynaphthalimides described in U.S. Pat. No. 3,782,941, the substituted phthalimides described in West German Patent Application (OLS) Nos. 2,140,406, 2,141,063 and U.S. Pat. 3,844,797, and the phthalazinone derivatives described in West German Patent Application (OLS) No. 2,220,618 can be used too.

Preferably each component used in the present invention is included in a binder so as to provide a homogeneous film on a support. Although preferred binders are generally hydrophobic, hydrophilic binders can also be used. These binders are transparent or semi-transparent. For example, proteins such as gelatin or gelatin derivatives, cellulose derivatives, polysaccharides such as dextran, natrual materials such as gum arabic, latex vinyl compounds which increase the dimensional stability of photographic materials and synthetic polymers described hereinafter can be used. Preferred synthetic polymers are those described in U.S. Pat. Nos. 3,142,586, 3,193,386, 3,062,674, 3,220,844, 3,287,289 and 3,411,911. Effective polymers include water-insoluble polymers of alkyl acrylates and methacrylates, acrylic acid, sulfoalkyl acrylates or methacrylates, and compounds having a repeating sulfobetaine unit as described in Canadian Patent 774,054. Examples of preferred high molecular weight materials and resins include polyvinyl butyral, polyacrylamide, cellulose acetate butyrate, cellulose acetate propionate, polymethyl methacrylate, polyvinyl pyrrolidone, polystyrene, ethyl cellulose, polyvinyl chloride, chlorinated rubber, polyisobutylene, butadiene-styrene copolymers, vinyl chloridevinyl acetate copolymers, vinyl acetate-vinyl chloride-maleic acid-terpolymers, polyvinyl alcohol, polyvinyl acetate, benzyl cellulose, polyvinyl acetate, acetylcellulose, cellulose propionate and cellulose acetate phthalate, etc. Of these polymers, polyvinyl butyral, polyvinyl acetate, ethyl cellulose, polymethyl methacrylate and cellulose acetate butyrate are more preferred. The most preferred material is polyvinyl butyral. If desired, two or more of these materials can be used as a mixture. The ratio by weight of the binder to the organic silver salt of component (a) generally ranges from about 10:1 to about 1:10 and preferably about 4:1 to about 1:4.

The layers containing each component described herein and other layers in the present invention can be applied to many kinds of supports. Examples of supports which can be used in the present invention are synthetic resin films such as cellulose nitrate films, cellulose ester films, polyvinyl acetal films, polyethylene films, polyethylene terephthalate films or polycarbonate films, etc., glass plates, paper and metal plates such as an aluminium plate, etc. Partially acetylated materials can also be used, Further, baryta paper, synthetic resin coated paper and water-resistant paper can be used as well. It is further preferred from the viewpoint of handling that the support is flexible. Art paper, coated paper and clay processed paper are preferred as paper supports. Paper which has been sized with a polysaccharide, etc., is also preferred. The organic silver salt and the silver halide are each used in the amount such that the sum total of silver amount of both coated on the support is about 0.2 g to about 3 g, preferably about 0.3 g to about 2 g, per $m^2$ of the support. If the amount coated is below about 0.2 g, the image density is low. If the amount coated is above about 3 g, the cost is increased while no additional advantages in photographic properties are achieved.

Certain spectral sensitizing dyes which are known to be effective for gelatin-silver halide emulsions can be used for the heat developable light-sensitive materials of the present invention in order to further increase the sensitivity. Effective spectral sensitizing dyes include cyanine, merocyanine, complex (trinuclear or tetranuclear) cyanine, holopolar cyanine, styryl, hemicyanine, oxonol and hemioxonol dyes. Of the cyanine dyes, those containing a basic nucleus such as a thiazoline, oxazoline, pyrroline, pyridine, oxazole, thiazole, selenazole or imidazole ring are suitable. Further, such a nucleus can have an alkyl group, an alkylene group, a hydroxyalkyl group, a sulfoalkyl group, a carboxyalkyl group, an aminoalkyl group or an enamine group as a substituent or can form a condensed carbocyclic group or heterocyclic group. The cyanine dyes can be either symmetric or asymmetric. Further, the dyes can have an alkyl group, a phenyl group, an enamine group or a heterocyclic substituent on the methine chain or the polymethine chain thereof. Particularly, cyanine dyes containing a carboxyl group are effective for sensitization. The merocyanine dyes can contain an acid nucleus such as a thiohydantoin nucleus, a rhodanine nucleus, an oxazolidindione nucleus, a thiazolidindione nucleus, a barbituric acid nucleus, a thiazolinone nucleus or a malonitrile nucleus in addition to the above-described basic nucleus. These acid nuclei can be substituted with an alkyl group, an alkylene group, a phenyl group, a carboxyalkyl group, a sulfoalkyl group, a hydroxyalkyl group, an alkoxyalkyl group, an alkylamino group or a heterocyclic nucleus. Particularly, merocyanine dyes having an imino group or a carboxyl group are effective for sensitization. If desired, these dyes can be used as a combination of two or more thereof. Further, they can be used together with ascorbic acid derivatives, azaindenes, cadmium salts, organic sulfonic acids or supersensitizing additives which do not absorb visible light as described in, for example, U.S. Pat. Nos. 2,933,390 and 2,937,089, etc. Effective sensitizing dyes for the heat developable light-sensitive materials of the present invention include merocyanine dyes containing a rhodanine nucleus, a thiohydantoin nucleus or a 2-thio-2,4-oxazolidindione nucleus as described in U.S. Pat. No. 3,761,279, for example, 3-p-carboxyphenyl-5-[β-ethyl-2-(3-benzoxazolylidenyl-)ethylidenyl-]-rhodanine, 5- [3-β-carboxyethyl-2-(3-thiazolinylidenyl)-ethylidenyl]-3-ethyl rhodanine, 3-carboxymethyl-5-[(3-methylthiazolinylidenyl)-α-ethylethylidenyl]rhodanine, 1-carboxymethyl-5-[(3-ethyl-2-(3H)-benzoxazolylidenyl)ethylidenyl]-3-phenyl-2-thiohydantoin, 5-[(ethyl-2-benzoxazolylidenyl)-1-methylethyl-idenyl]-3-[(3-pyrrolin-1-yl)propyl]-rhodanine and 3-ethyl-5-[(3-ethyl-2-(3H)-benzothiazolylidenyl)isopropylidenyl]-2-thio-2,4-oxazolidindione, etc. Trinuclear merocyanine dyes as described in U.S. Pat. No. 3,719,495, polynuclear aromatic dyes as described in Belgian Patent 788,695, sensitizing dyes for silver iodide as described in West German Patent Application (OLS) 2,328,868, styrylquinoline dyes as described in West German Patent Application (OLS) 2,363,586, rhodacyanine dyes as described in West German Patent Application (OLS) 2,405,713, acid dyes such as 2′,7′-dichlorofluoroscein dyes as described in West German Patent Applications (OLS) 2,404,591, 2,401,982, and 2,422,337 and merocyanine dyes as described in Japanese Patent Application 10,815/1974 are other examples of sensitizing dyes which can be similarly used in the present invention. The amount of these dyes generally ranges from about $10^{-4}$ to about 1 mol per mol of the light-sensitive silver halide or the silver halide forming component.

The heat developable light-sensitive materials used in the present invention can have an antistatic layer or an electrically conductive layer. These layers can contain soluble salts such as halides or nitrates, ionic polymers as described in U.S. Pat. Nos. 2,861,056 and 3,206,312 and insoluble inorganic salts as described in U.S. Pat. No. 3,428,451. Further, the heat developable light-sensitive materials can have an evaporation-deposited metal layer. If desired, the heat developable light-sensitive materials of the present invention can contain an antihalation material or an antihalation dye. Preferred examples of such dyes are those dyes which are decolored upon heat development. For example, the dyes described in U.S. Pat. Nos. 3,768,019, 3,745,009 and 3,615,432 are preferred. Further, filter dyes or light absorbing materials as described in U.S. Pat. Nos. 3,253,921, 2,527,583 and 2,956,879 can be incorporated into the heat developable light-sensitive materials of this invention. If desired, the heat developable light-sensitive materials of the present invention can contain a matting agent such as starch, titanium dioxide, zinc oxide, silica, polymer beads such as those described in U.S. Patents 2,922,101 and 2,761,245, kaolin or clay, etc. Furthermore, they can contain an optical whitening agent such as the stilbenes, triazines, oxazoles or coumarins as described in, for example, German Patents 972,067 and 1,150,274, French Patent 1,530,244 and U.S. Pat. Nos. 2,933,390 and 3,406,070. These optical whitening agents can be used as an aqueous solution or as a dispersion.

The heat developable light-sensitive materials of the present invention can additionally contain a plasticizer and a lubricant. For example, glycerin, diols, polyhydric alcohols as described in U.S. Pat. No. 2,960,404, aliphatic acids or esters as described in U.S. Pat. Nos. 2,588,765 and 3,121,060 and silicone resins described in, for example, British Patent 955,061 can be used as plasticizers and lubricants. Furthermore, the light-sensitive materials can contain a surface active agent, for example, saponin and alkylaryl sulfonates described in, for example, U.S. Pat. 2,600,831, ampholytic compounds described in, for example, U.S. Pat. 3,133,816 and addition products of glycidol and alkyl phenols described in, for example, British Patent 1,002,878. Hardenable layers of the heat developable light-sensitive layers used in the present invention can be hardened by organic or inorganic hardening agents. These hardening agents can be used individually or as a combination of two or more thereof. Preferred hardening agents are aldehydes, blocked aldehydes, ketones, carboxlic acids, carbonic acid derivatives, sulfonic acid esters, sulfonyl halides, vinyl sulfonyl esters, active halogen compounds, epoxy compounds, aziridines, active olefins, isocyanates, carbodiimides and polymeric hardening agents such as dialdehyde starch, etc. Further, many additives can be used for increasing the density of the resulting images. For example, non-aqueous polar organic solvents such as compounds having a group $$-\underset{\underset{O}{\|}}{C}-,\quad -\underset{\underset{O}{\|}}{S}-$$

or $-SO_2-$ as described in U.S. Pat. No. 3,667,959, for example, tetrahydrothiophene-1,1-dioxide, 4-hydroxybutanoic acid lactone and methylsulfinyl methane are effective. Zinc, cadmium and copper acetates as described in U.S. Pat. No. 3,708,304 are also effective. Furthermore, compounds containing water of crystallization as described in U.S. Pat. No. 3,635,719, acid salts of amines and compounds which become alkaline on heating such as metal oxides or hydroxides are effective as the materials for accelerating development. It is possible to use polyalkylene glycols together with mercaptotetrazole in order to improve the sensitivity, contrast and image density as described in U.S. Pat. No. 3,666,477.

Various methods can be utilized in order to prevent the generation of heat fog of the heat developable light-sensitive materials of the present invention. One method comprises using mercury compounds, as described in U.S. Pat. No. 3,589,903. Further, it is possible to form direct positive images using mercury compounds as described in U.S. Pat. No. 3,589,901. Furthermore, the mercury compounds can be used together with color forming couplers in order to form stabilized color images as described in U.S. Pat. No. 3,764,328. A second method for preventing the generation of heat fog is described in West German Patents (OLS) 2,326,865, 2,402,161, 2,364,630, wherein N-halo compounds such as N-halosuccinimides or N-haloacetamides are used. Other methods for preventing the generation of heat fog are described in U.S. Pat. No. 3,645,739, West German Patent Application (OLS) 2,445,038, and Japanese Patent Applications (OPI) 89,720/1973 and 125,016/1974, wherein higher aliphatic acids such as lauric acid, myristic acid, palmitic acid, stearic acid or behenic acid, etc., tetrahalophthalic acid or the anhydride thereof, aryl sulfonic acids such as benzene sulfonic acid or p-toluene sulfonic acid, aryl sulfinic acid or salts thereof such as benzene sulfinic acid or p-toluene sulfinic acid, and lithium salts of higher aliphatic acids such as lithium stearate, etc., are used as acid stabilizing agents. Other effective acid stabilizing agents include salicylic acid, p-hydroxybenzoic acid, tetrabromobenzoic acid, tetrachlorobenzoic acid, p-acetamidobenzoic acid, alkyl substituted benzoic acids such as p-t-butylbenzoic acid, phthalic acid, isophthalic acid, trimellitic acid, pyromellitic acid, diphenic acid, and 5′,5′-methylene-bis-salicylic acid. These acid stabilizing agents not only prevent the generation of heat fog but also sometimes have the functions of preventing discoloration when exposed to white light, increasing the image density or improving the shelf life (the property that the photographic properties of the light-sensitive material possessed just after production are maintained after storage). Other compounds which are effective for preventing generation of heat fog are benzotriazole and derivatives thereof, thiourcils, for example, 2-thiouracils represented by the formula (VI):

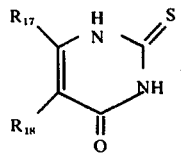

(VI)

wherein $R_{17}$ represents a hydrogen atom; a hydroxyl group, an alkoxy group, a halogen atom, an unsubstituted or substituted lower alkyl group, a benzyl group, an allyl group, an amino group, a nitro group or a nitroso group, and $R_{18}$ represents a hydrogen atom, a hydroxyl group, a halogen atom, an amino group, an acetamido group an unsubstituted or substituted alkyl group having 1 to 22 carbon atoms, an aryl group, such as a phenyl group, or a substituted aryl group, mercapto compounds such as 1-phenyl-5-mercaptotetrazole, azole thioethers or blocked azolethiones, and peroxides or persulfates as described in Japanese Patent Applicaion 5,453/1974. Also, effective prevention of the generation of heat fog or improvement in photographic properties such as sensitization can be achieved if chromium salts, rhodium salts, copper salts, nickel salts, cobalt salts and complex salts of rhodium, iron or cobalt are present during formation or before formation of silver halide.

In order to prevent discoloration by light of the processed light-sensitive material (the phenomenon in which the unexposed area of the light-sensitive material after processing is discolored gradually by light when exposed to normal room illumination), it is possible to use stabilizer precursors such as azole thioethers or blocked azolethiones as described in U.S. Pat. No. 3,839,049, tetrazolyl thio compounds as described in U.S. Pat. No 3,700,457 and light-sensitive halogen-containing organic oxidizing agents as described in U.S. Pat. No. 3,707,377.

In addition, it is possible to use light absorbing dyes as described in British Patent 1,261,102, for, particularly, transmission light-sensitive materials in order to improve the resolving power. Further, it is possible to use leuco dye compounds described in, for example, West German Patent Application (OLS) 2,446,892 in order to improve the shelf life.

Further, it is possible in some cases to stabilize the processed light-sensitive materials to light or heat. Effective methods include the process described in U.S. Pat. No. 3,617,289 which comprises stabilizing the materials using a solution containing mercapto compounds and the method described in West German Patent Applicatin (OLS) 2,443,292 which comprises providing a laminate containing a stabilizing agent.

Further, it is possible to provide, if desired, a topcoating polymer layer on the light-sensitive layer in order to enhance the transparency of the heat developable light-sensitive layer, to increase the image density and to improve the shelf life, as described in West German Patent Application (OLS) 2,323,452. A preferred thickness for the top coating polymer layer ranges from about 1 micron to about 20 microns. Examples of polymers suitable for the top-coat polymer layer include polyvinyl chloride, polyvinyl acetate, vinyl acetate-vinyl chloride copolymers, polystyrene, polymethyl methacrylate, methyl cellulose, ethyl cellulose, cellulose acetate butyrate, cellulose acetate, polyvinylidene chloride, cellulose propionate, cellulose acetate phthalate, polycarbonate, cellulose acetate propionate and polyvinyl pyrrolidone, etc. A top coat polymer layer containing a material such as kaolin, silica or a polysaccharide such as starch therein, as described in Belgian Patent 798,367 and Japanese Patent Application (OPI) 46,316/1975 provides the heat developable light-sensitive material with the ability to be written upon with a ball-point pen or a pencil. Further, the top coat polymer layer can contain a filter dye, an ultraviolet light absorbing agent or an acid stabilizing agent such as higher aliphatic acids, etc.

The heat developable light-sensitive layers, the top-coat polymer layer, a subbing layer, a back layer and other layers used in the present invention can be coated on a support using various coating methods. Examples of such methods are a dip-coating method, an air-knife coating method, a curtain coating method and a hopper coating method. If desired, two or more layers can be coated at the same time using the methods described in U.S. Pat. No. 2,761,791 and British Patent 837,095.

The heat developable light-sensitive materials as in the present invention generally have the characteristic that the photographic properties thereof are easily deteriorated by moisture. Therefore, when the prepared light-sensitive materials are packed and sent into the trade as commodities, a drying agent, as described in West German Patent Application (OLS) 2,422,040, is generally packed with the materials.

The heat developable light-sensitive materials of the present invention can have a subbing layer between the support and the heat developable light-sensitive layer. Examples of binders which can be used for such a subbing layer include various polymers as described hereinbefore. For example, polyvinyl butyral, polyacrylamide, cellulose acetate butyrate, cellulose acetate propionate, polymethyl methacrylate, polystyrene, polyvinyl pyrrolidone, ethyl cellulose, polyvinyl chloride, chlorinated rubber, polyisobutylene, butadiene-styrene copolymers, vinyl chloride-vinyl acetate copolymers, vinyl acetate-vinyl chloride-maleic acid terpolymers, polyvinyl alcohol, polyvinyl acetate, cellulose acetate, cellulose propionate, cellulose acetate phthalate, gelatin, gelatin derivatives and polysaccharides, etc., can be used. It is possible to improve the photographic properties such as lightdiscoloration or heat fog, etc., by incorporating aliphatic acids or metal salts thereof in the subbing polymer layer. Further, it is possible to prevent permeation of solvents by incorporating pigments such as clay into the subbing layer. In addition, a matting agent such as silica, kaolin, titanium dioxide or zinc oxide can be added to the subbing layers. Further, a nonelectrolyte deposition layer composed of a conductive metal as described in U.S. Pat. No. 3,748,137 can be present. It is also possible to improve the moisture resistance or to prevent curling in a case of a paper support by providing a hydrophobic polymer layer on the back of the support.

The heat developable light-sensitive materials of the present invention are developed by heating after image exposure.

The light-sensitive materials of the invention can be preheated before exposure to light as described above (to about 80° C to 140° C). Light sources suitable for image exposure are tungsten lamps, fluorescent lamps used for exposing diazotype light-sensitive materials, mercury lamps, xenon lamps, cathode ray tube (CRT)

light sources and laser light sources, etc. As originals, not only line images such as drawings but also photographic images having a gradation can be used. Further, it is possible to directly photograph people and landscapes using a camera. The light-sensitive materials can be printed by direct contact of the light-sensitive material with the original, or can be printed using a reflection printing method or using an enlarged printing method. Although exposure depends upon the sensitivity of the light-sensitive materials, an exposure of about 10 luxes second is required for high speed sensitive materials and an exposure of about $10^4$ luxes second is required for low speed sensitive materials. The thus image-exposed light-sensitive materials can be developed simply by heating (e.g., to about 100° C to about 150° C). The heating time can be suitably, for example, about 1 second to 60 seconds. The heating time, of course, is related to the heating temperature employed. In general, a suitable heating time is about 5 seconds to about 40 seconds at 120° C, about 2 seconds to about 20 seconds at 130° C and about 1 second to about 10 seconds at 140° C.

Various means can be used for heating. For example, the light-sensitive material can be contacted with a simple heated plate or with a heated drum or, if desired, it can be passed through a heated space. Further, the heating can be carried out by high frequency heating or by laser beams. In order to prevent a bad odor from being emitted on heating, the processing devices can be equipped with a deodorizer. It is also possible to incorporate a certain perfumes so as to mask any bad odor of the light-sensitive materials which might be formed.

The preparation of heat developable light-sensitive materials of the invention will be illustrated by reference to the following Examples and is briefly explained as follows.

An organic silver salt-forming agent is reacted with a silver ion-providing agent (e.g., silver nitrate) using one of the various methods described above to form an organic silver salt. The preparation conditions are about −15° C to 80° C, preferably about 20° to 60° C. After washing the prepared organic silver salt with water or an alcohol, the salt is dispersed in a binder for an emulsion using a colloid mill, a mixer or a ball mill at normal temperature (e.g., about 15° to 25° C). To the polymer dispersion of the silver salt, the N-halo compound of this invention and, if desired, a silver halide forming agent are added to convert a part of the organic silver salt to silver halide. In this case, the reaction temperature ranges from about normal temperature to about 80° C, and the reaction time is up to about 48 hours. Further, a previously prepared silver halide as described above can be added, or silver halide can be simultaneously prepared along with the organic silver salt. Then, any additives such as spectral sensitizing dyes, reducing agents or toning agents are added, preferably as solutions thereof. These solutions are usually added at suitable intervals (e.g., about 5 to 20 minutes) to the system with stirring at about normal temperature to 50° C. When all additives have been added, the coating composition is then coated on a suitable support using a coating apparatus. The temperature of the coating ranges from about 5° to 50° C. The drying temperature of the coated layers is about 3 to 100° C and the coating speed is about 3 to 150 meter/min. If desired, the overcoating polymer layer, the subbing layer and the backing layer can be coated under similar conditions. Also, these additional layers can be simultaneously coated.

The heat developable light-sensitive materials of the invention have little heat fog and the processed materials have improved light-stability.

The invention will be illustrated in greater detail by reference to the following Examples.

EXAMPLE 1

Into 100 m*l* benzene at 60° C, 3.4 g of behenic acid was dissolved and further 100 m*l* of water was added to the solution at 60° C with stirring to produce an emulsion. To the emulsion, 100 m*l* of an aqueous solution silver ammine complex salt at 10° C was added to form fine particles of silver behenate. The aqueous silver ammine complex salt solution was prepared by adding an aqueous ammonia solution to about 80 m*l* of an aqueous solution containing 1.7 g of silver nitrate and then adding water to make the total volume 100 m*l*.

The reaction mixture was allowed to stand for 20 minutes at 25° C to separate the water layer and the benzene layer. After the water layer was removed and then 400 m*l* of water was added and decanted off. Further, 400 m*l* of methanol was added and centrifugally separated to obtain 4 g of silver behenate crystals which were spindle-shaped having a size of 1 × 0.05 micron.

In 20 m*l* of an ethanol solution of 2.5 g of polyvinyl butyral, 2, 3 g (about 1/200 mol) of thus-prepared silver behenate was dispersed, 3 m*l* of a 1.5% acetone solution of an N-halo compound of the invention (Compound 1) was added, followed by heating at 60° C for 100 minutes, and then the following additives each were added at intervals of 5 minutes at 50° C in the order listed:

1. Merocyanine Dye* (0.025 wt% methyl Cellosolve solution)
2. 2,2′-Methylene-bis(6-tert-butyl-4-methylphenol) (reducing agent) (25 wt% acetone solution) 3 ml.
3. Phthalazone (toning agent) (2.5 wt% methyl Cellosolve solution) 3 ml.

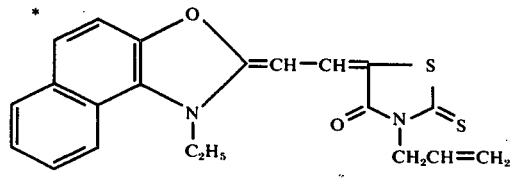

The thus-prepared coating solution was coated on an art paper in a silver coating amount of 1 g/m² and then dried to provide a heat developable light-sensitive material (Sample 1).

The same procedure as described above was repeated except that ammonium bromide was employed instead of the N-halo compound of the invention to provide a comparative heat developable light-sensitive material (Comparative Sample 1).

Sample 1 and the Comparative Sample 1 each was imagewise exposed through an original having a continuous tone to radiation from a tungsten lamp (exposure amount 3,000 lux·sec), and then heated to 120° C for about 30 seconds. From Sample 1, images having a high contrast were obtained without any heat fog, but fog occurred all over the surface of Comparative Sample 1. These developed samples were allowed to stand under room light and, as a result, the color of the images of Sample 1 did not change but the color of the images of Comparative Sample 1 changed.

Where radiation from a mercury lamp, a xenon lamp, a CRT light source, a fluorescent lamp or laser light source was used instead of the tungsten lamp, or the development condition was 140° C and 12 seconds, similar results were obtained. As is apparent from the above, heat fog and color change do not depend on a kind of light source used for irradiation nor on the heating conditions, and it was confirmed that the N-halo compound of the invention provides marked results.

EXAMPLE 2

In 100 m*l* of water, 1.9 g of sodium hydroxide was dissolved, and the solution was mixed with 100 m*l* of a toluene solution containing 12 g of lauric acid to provide an emulsion. To this 50 m*l* of water containing 8.5 g of silver nitrate was then added and the mixture was allowed to stand for 5 minutes, whereby a toluene layer containing silver laurate and a water layer were separated. After removing the water layer, 200 m*l* of ethanol was added to the toluene layer to disperse the reaction product therein and the product was centrifugally separated to obtain 12 g of silver laurate crystals having a spindle-shape of about 3 microns in longer diameter.

In 70 g of ethyl alcohol, 6 g of silver laurate (about 1/50 mol) and 12 g of polyvinyl butyral were dispersed to provide a polymer dispersion of the silver salt. To the dispersion kept at 60° C with stirring, 0.15 g of an N-halo compound of the invention (Compound 1) was added and heated to 100° C. The mixture was cooled to 30° C and while the mixture was kept at this temperature with stirring, the following components were added at intervals of 5 minutes in the order listed to provide a coating composition:

1. Merocyanine Dye* (spectral sensitizing dye) (0.025 wt% methyl Cellosolve solution) 10 m*l*
2. Lauric Acid (acid stabilizer) (3 wt% methyl Cellosolve solution) 35 m*l*
3. Phthalazone (toning agent) (3 wt% methanol solution) 50 m*l*
4. 2,2-bis(3,5-Dimethyl-4-hydroxyphenyl)propane (reducing agent) (20 wt% acetone solution) 30 m*l*

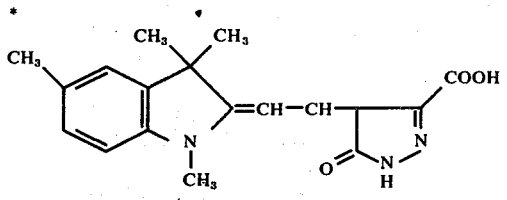

The coating solution was coated on a baryta paper in a silver amount of 0.3 g/m² and on a polyethylene terephthalate film in a silver amount of 1.5 g/m². On each light-sensitive layer, a 10 wt% ethanol solution of ethyl cellulose was coated to provide an overcoated polymer layer containing silica in the amount of 10 wt% to the ethyl cellulose in a thickness of about 1.5 microns in the case of the baryta support and a 15 wt% tetrahydrofuran solution of a vinyl chloride-vinyl acetate copolymer (monomer weight ratio: 85:15) was coated to provide an overcoated polymer layer in a thickness of about 3 microns in the case of the polyethylene terephthalate film. The heat developable light-sensitive materials produced were designated Sample 2-1 and Sample 2-2, respectively.

The same procedures as above were repeated except that ammonium bromide was employed instead of the N-halo compound of the invention to produce heat developable light-sensitive materials (Comparative Sample 2-11 and Comparative Sample 2-12). Further, the same procedures as above were repeated except that the same molar amount of N-bromoacetamide was employed instead of the N-halo compound of the invention to produce heat developable light-sensitive materials (Comparative Sample 2-21 and Comparative Sample 2-22).

Each of the heat developable light-sensitive materials was imagewise exposed and developed under heating in the same manner as in Example 1 to form images. The image densities and color change to light of each of the samples were measured. With respect to the image density, a maximum density and a heat fog density were measured. With respect to the color change to light, the density of the background portions of the developed light-sensitive material directly after development, and the density of the same portions after exposure of the developed sample to radiation of about 800 luxes for about 48 hours were measured, and the difference between these two values was calculated. With a larger difference, the larger is the color change. The results obtained are shown in Table 1.

TABLE 1

| Sample | | Heat Fog Density | Maximum Density | Color Change |
|---|---|---|---|---|
| Paper Support | | | | |
| | 2–1 | 0.10 | 1.6 | 0.02 |
| | 2–11* | 0.9 | 1.4 | 0.15 |
| | 2–12* | 0.15 | 1.4 | 0.04 |
| Film Support | | | | |
| | 2–2 | 0.05 | 2.5 | 0.01 |
| | 2–21* | 1.3 | 2.3 | 0.12 |
| | 2–22* | 0.12 | 2.4 | 0.03 |

*Comparative sample

The results in Table 1 demonstrate that the samples of the invention provide higher image densities, less heat fog and less color change than those of the comparative samples.

EXAMPLE 3

A solution of 8.5 g of capric acid dissolved in 100 m*l* of butyl acetate was kept to 5° C, and 0.7 g of an N-halo compound of the invention (Compound 2) was emulsified in the solution with stirring. To the emulsion, 50 m*l* of an aqueous solution of silver ammine complex salt containing 8.5 g of silver nitrate (5° C) was added dropwise over a period of 30 seconds to react the capric acid, hydrogen bromide and silver ion and to form silver caprate and silver bromide, simultaneously. After removing the water layer, the butyl acetate layer containing the silver caprate and silver bromide was dispersed in 120 g of a 15 wt% isopropanol solution of polyvinyl butyral using a mixer to provide a polymer dispersion of the silver salt. To the polymer dispersion of the silver salt, the following components were added at intervals of 5 minutes at 40° C to provide a coating solution which was then coated on a coated paper in a silver amount of 0.7 g/m² to obtain a heat developable light-sensitive material (Sample 3).

For comparison, the same procedures as described above were repeated except that hydrogen bromide in the same molar amount was employed instead of the N-halo compound of the invention to provide a heat developable light-sensitive material (Comparative Sample 3).

In the same manner as in Example 1, images were produced on the above samples, and the image densities and color change to light were measured in the same manner as in Example 2. Heat fog was not formed in Sample 3 and the developed material from Sample 3 was stable to light, but heat fog was formed in Comparative Sample 3 and the background of the developed material from Comparative Sample 3 immediately turned brown.

EXAMPLE 4

In 100 m*l* of isoamyl acetate, 6 g of benzotriazole was dissolved at 50° C, and then the solution was cooled to −15° C. To the solution, 100 m*l* of a dilute nitric acid aqueous solution containing 8.5 g of silver nitrate and having a pH of 2.0 (25° C) was added at 3° C with stirring to provide a dispersion containing fine particles of silver benzotriazole. After removing the water layer, 400 m*l* of water was added to the isoamyl acetate layer and washed by decantation. Then, 400 m*l* of methanol was added and the dispersion was centrifugally separated to obtain 8 g of silver benzotriazole having a diameter of about 1 micron.

Into 40 m*l* of a methyl ethyl ketone solution containing 4 g of ethyl cellulose, 2.5 g of silver benzotriazole was added and mixed for 1 hour using a ball mill to provide a polymer dispersion of the silver salt.

To 45 g of the polymer dispersion, 0.1 g of an N-halo compound of this invention (Compound 3) was added, and the dispersion was heated at 60° C for 50 minutes. Then the following components were added to the dispersion at intervals of 10 minutes in the order listed to provide a coating solution. The coating solution was coated on a paper coated with clay and styrene-butadiene rubber in a silver amount of 1 g/m$^2$ to provide a heat developable light-sensitive material (Sample 4).

For comparison, the same procedures as above were repeated except that cadmium bromide in the same molar amount was employed instead of the N-halo compound of the invention to provide a heat developable light-sensitive material (Comparative Sample 4).

These samples were imagewise exposed and developed under heating at 130° C for 15 seconds in the same manner as in Example 1. The thus-obtained samples were evaluated in the same manner as in Example 2. Little heat fog and color change occurred in Sample 4, but remarkable heat fog and color change occurred in Comparative Sample 4.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material comprising a support having therein or in one or more layers thereon (a) an organic silver salt which is comparatively stable to light, is substantially colorless and reacts with a reducing agent on heating in the presence of exposed silver halide to produce silver images, (b) a light-sensitive silver halide, and (c) a reducing agent, with said light-sensitive silver halide comprising the reaction product of a part of the organic silver salt (a) and an N-halo compound represented by the following formula (I):

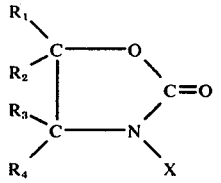

(I)

wherein $R_1$, $R_2$, $R_3$ and $R_4$ each is a hydrogen atom; an alkyl group having 1 to 22 carbon atoms; a haloalkyl group having 1 to 22 carbon atoms; an amino group; a hydroxyalkyl group having 1 to 22 carbon atoms; an allyl group; a naphthyl group; a benzyl group; a

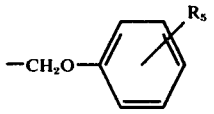

group in which $R_5$ is a hydrogen atom, a halogen atom, an alkyl group, an alkylthio group, an amino group or an alkylamino group; a benzyloxy group; an aryl group; a haloaryl group; an alkylaryl group; an alkoxyaryl group; an $—OR_6$ group in which $R_6$ is a hydrogen atom, an alkyl group, an allyl group, an aryl group or an alkoxyaryl group; a

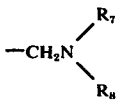

group in which $R_7$ and $R_8$ each is a hydrogen atom, an alkyl group, an aryl group or an allyl group; a cyclohexyl group; a $—CH_2OR_9$ group in which $R_9$ is a naphthyl group; or a $—CH_2R_{10}$ in which $R_{10}$ is a morpholino group, a piperadino group or an alkylthio group; and X is a chlorine atom or a bromine atom.

2. The heat-developable light-sensitive material of claim 1, wherein said organic silver salt is a silver salt of an organic compound containing an imino group, a mercapto group, a thione group or a carboxyl group.

3. The heat-developable light-sensitive material of claim 2, wherein said organic silver salt is an organic silver carboxylate.

4. The heat-developable light-sensitive material of claim 3, wherein said organic silver salt is a silver salt of an aliphatic long chain fatty acid.

5. The heat-developable light-sensitive material of claim 1, wherein said reducing agent is a substituted phenol, an unsubstituted or substituted bisphenol, an unsubstituted or substituted bisnaphthol, a di- or polyhydroxybenzene, a di- or polyhydroxynaphthalene, a hydroquinone monoether, ascorbic acid or a derivative thereof, a 3-pyrazolidone, a pyrazolin-5-one, a reducing saccharide, a p-phenylenediamine or a derivative thereof, a reductone, kojic acid, hinokitiol, a hydroxylamine, a hydroxytetronic acid, a hydroxytetronamide, a hydroxyoxamic acid, a sulfohydrooxamic acid, a hydrazide, an indan-1,3-dione, a p-oxyphenylglycine, an ester of a carboxylic acid derived from a phenol having a bulky substituent in at least one ortho-position with a monohydric or polyhydric alcohol or phenol, or an ester of an alcohol derived from a phenol having a bulky substituent in at least one ortho-position or a phenol having a bulky substituent in at least one ortho-position with a mono- or polycarboxylic acid.

6. The heat-developable light-sensitive material of claim 1, wherein the compound represented by the formula (I) is present in an amount of about 0.001 to 0.5 mol per mol of the organic silver salt.

7. The heat developable light-sensitive material of claim 6, wherein the amount of the organic silver salt (a) and the light-sensitive silver halide (b) ranges from about 0.2 to about 3 $g/m^2$ of the support.

* * * * *